US010401026B2

(12) United States Patent
Malm et al.

(10) Patent No.: US 10,401,026 B2
(45) Date of Patent: Sep. 3, 2019

(54) AUXILIARY BURNER ASSEMBLY AND CONTROL SYSTEM FOR COMBUSTING VENT GASES IN PETROLEUM PRODUCTION AND PROCESSING

(71) Applicant: REM Technology Inc., Calgary, Alberta (CA)

(72) Inventors: Howard L. Malm, Coquitlam (CA); Leslie A. Keast, Calgary (CA)

(73) Assignee: REM Technology Inc., Calgary (CA)

( * ) Notice: Subject to any disclaimer, the term of this patent is extended or adjusted under 35 U.S.C. 154(b) by 147 days.

(21) Appl. No.: 15/431,288

(22) Filed: Feb. 13, 2017

(65) Prior Publication Data

US 2017/0211806 A1 Jul. 27, 2017

Related U.S. Application Data

(63) Continuation-in-part of application No. 14/448,492, filed on Jul. 31, 2014, now Pat. No. 9,568,191.

(51) Int. Cl.
*F23D 14/20* (2006.01)
*F23G 7/08* (2006.01)

(52) U.S. Cl.
CPC ..... *F23G 7/085* (2013.01); *F23N 2037/02* (2013.01); *F23N 2041/18* (2013.01)

(58) Field of Classification Search
CPC ... F23G 7/085; F23G 7/00; F23G 7/08; F23N 2037/02; F23N 2041/18; F23D 14/04; F23D 23/00
See application file for complete search history.

(56) References Cited

U.S. PATENT DOCUMENTS 7,520,743 B1 * 4/2009 Roberts ..... E21B 43/34 196/46

* cited by examiner

*Primary Examiner* — Alfred Basichas
(74) *Attorney, Agent, or Firm* — Garvey, Smith & Nehrbass, Patent Attorneys, L.L.C.; Seth M. Nehrbass; Fabian M. Nehrbass

(57) ABSTRACT

An auxiliary burner assembly is provided within the exhaust stack associated with a main burner assembly for combusting vent gases from a petroleum production and processing facility. The auxiliary burner unit is located within the exhaust stack associated with the main burner assembly. The auxiliary burner assembly enables the same exhaust stack as the main burner assembly while effective combusting exhaust gases and providing heating of a medium when required. The auxiliary burner is utilized when the main burner assembly is inactive and can be utilized to improve airflow to initiate the main burner assembly. An auxiliary burner controller system is utilized to control operation of the auxiliary burners.

20 Claims, 12 Drawing Sheets

AUXILIARY BURNER ASSEMBLY AND CONTROL SYSTEM FOR COMBUSTING VENT GASES IN PETROLEUM PRODUCTION AND PROCESSING

CROSS-REFERENCE TO RELATED APPLICATION

This application is a continuation-in-part of U.S. patent application Ser. No. 14/448,492 which is incorporated by reference for all purposes which claims the benefit of Canadian Patent Application Serial No. 2,822,267, filed 31 Jul. 2013 which is hereby incorporated by reference for all purposes.

TECHNICAL FIELD

The present disclosure relates to vent gases resulting from petroleum production and processing and in particular to the combustion of the excess vent gases using an auxiliary burner.

BACKGROUND

The venting of hydrocarbon vapors into the atmosphere has been a common practice at many petroleum production and processing facilities. Often, where the amounts are substantial, the vapors are collected, recompressed and used. There are many other locations where these vapors are vented to the atmosphere. Recently, as of 2012/2013, the United States Environmental Protection Agency (EPA) has placed an upper limit on the amount of volatile organic vapors (VOCs) that may be vented. There is also a desire to minimize the venting of methane gases or gases that decompose to methane to the atmosphere because methane has a strong greenhouse gas heat trapping effect, being twenty-one times more effective than carbon dioxide over a 100 year period.

Vent gases originate from petroleum liquids that are stored in one or more tanks but can come from many sources in the extraction, collection, storage, processing and transportation of oil and gas. A pressure relief devices that allow the gases to escape to the atmosphere if a specified pressure is exceeded. To prevent the escape of the vent gases to the atmosphere these vent gases are directed to a burner system that consumes the gas vapors at a pressure below the pressure relief set-point.

An effective method to deal with the vented gases is to combust the gases under controlled circumstances. The standard method of combusting these gases is to feed these gases to an incinerator unit or flare where a pilot, either continuous or started on demand, feeds into the vented gases in the presence of air to ignite the gases. In the case of a flare, the vent gases are directed through a vertical tube or pipe and burned as the gases contact air. Since a flare is undesirable from an environmental and public perception point of view, the general preference is to enclose the flame and to regulate the air flow to achieve combustion with good air-fuel ratio control. The disadvantage with flares and incinerators is that the heat energy from the vapor combustion is lost and not used. In addition, adding a flare or incinerator to a site may require additional effort to obtain permission for installation and operation by regulatory authorities.

In many of the petroleum production processes fired heater units are employed for a multitude of purposes. Such heaters are used on an intermittent basis in response to the process requiring the heat energy and as a result are not always available to combust the vent gases. Typically these heaters use a burner jet where the fuel is introduced and a horizontal fire tube for directing the flame and the hot combustion gases to the medium requiring the heat and then to a vertical stack for directing the exhaust gases to the atmosphere. The horizontal portion may be simply one pipe or several parallel pipes connected to a stack, a U arrangement or a multi-pass arrangement where the pipe or pipes make several passes through the medium to be heated. The use of heaters can provide an effective solution to using vent gases however varying demand requirements can result in times when heating of the medium is not required and the vent gases must be dealt with.

Accordingly, systems and methods that enable a novel way of combusting excess vent gases when a main burner is not in operation remains highly desirable.

BRIEF DESCRIPTION OF THE DRAWINGS

Further features and advantages of the present disclosure will become apparent from the following detailed description, taken in combination with the appended drawings, in which.

It will be noted that throughout the appended drawings, like features are identified by like reference numerals.

DETAILED DESCRIPTION

Figure 1:
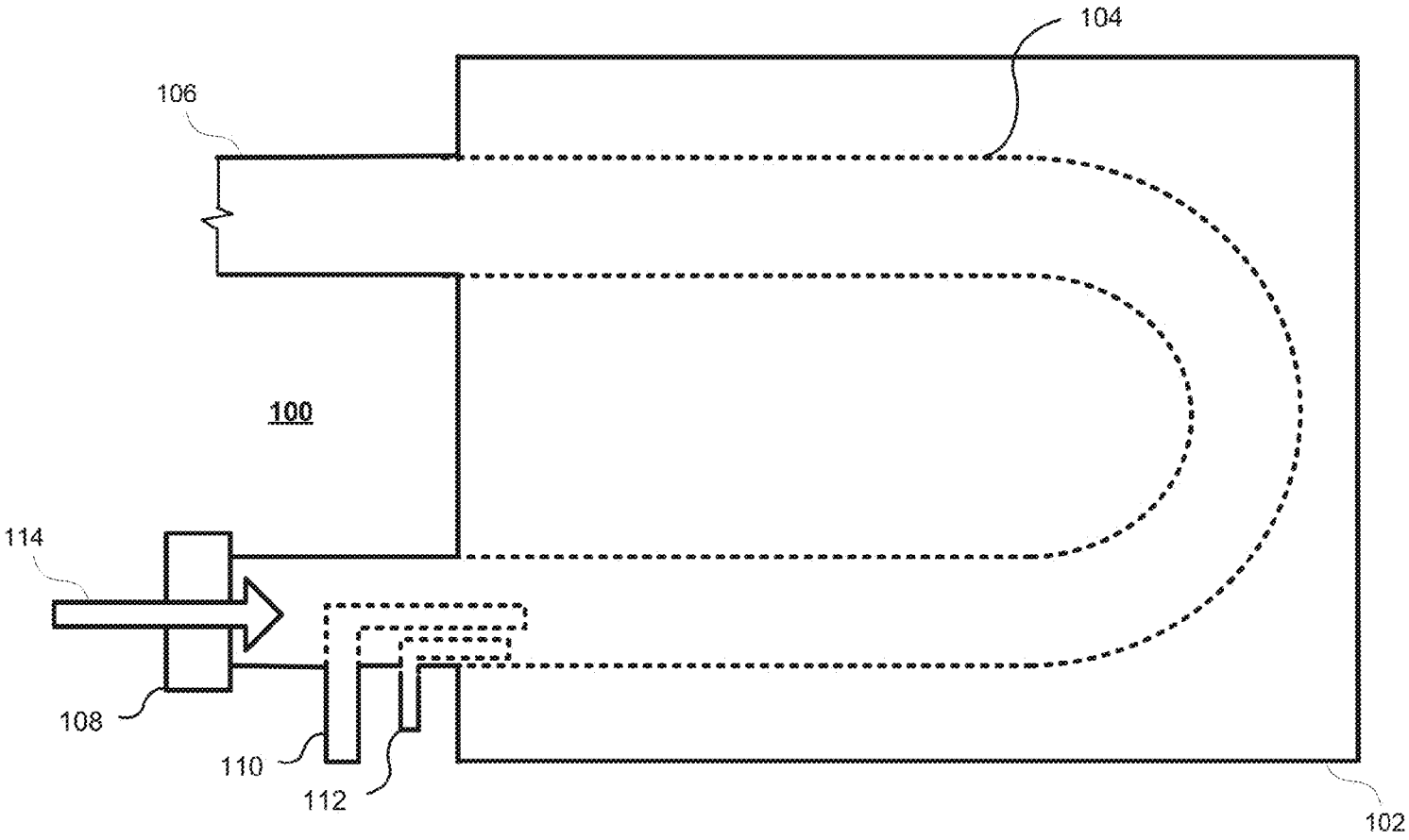
FIG. 1 shows a representation of a top view of a burner assembly with an exhaust gas stack.

Embodiments are described below, by way of example only, with reference to FIGS. 1-13.

In accordance with an aspect of the present disclosure there is provided an auxiliary burner assembly for combusting excess combustible vent gases, the auxiliary burner assembly comprising: a first auxiliary burner unit housed within an exhaust stack of a main burner assembly above the main burner assembly, the first auxiliary burner unit for combusting vent gases received from a vent gas supply line; and an outer pipe for supporting the first auxiliary burner unit within a center of the outer pipe having a diameter equal to or larger than a main fire tube of the main burner assembly; and wherein the first auxiliary burner unit combusts vent gases when the main burner assembly is inactive.

In accordance with another aspect of the present disclosure there is provided a method for controlling an auxiliary burner assembly, the method comprising: initiating an auxiliary burner of the auxiliary burner assembly positioned in an exhaust stack of a main burner assembly; initiating a main pilot of the main burner assembly; initiating the main burner of the main burner assembly; determining the air flow velocity in the main burner assembly; and shutting off auxiliary burner assembly when air flow velocity reaches a pre-determined threshold.

In accordance with yet another aspect of the present disclosure there is provided an auxiliary burner assembly for combusting excess combustible gases from a vent gas tank, the auxiliary burner assembly comprising: a first auxiliary burner unit housed within an exhaust stack of a main burner assembly, the first auxiliary burner unit for combusting vent gases received from a vent gas supply line from the vent gas tank; and an outer pipe for supporting the first auxiliary burner unit within a center of the outer pipe having a diameter equal to the exhaust gas stack of the main burner assembly; and wherein the first auxiliary burner unit is utilized to combust vent gases from the vent gas tank when the vent gases exceed a first pressure set-point and the main burner assembly is inactive.

In accordance with an aspect of the present disclosure there is provided a method for controlling an auxiliary burner assembly for combusting vent gases, the method comprising: determining a state of a main burner assembly; determining a pressure value of vent gas in a vent gas tank; and initiating the auxiliary burner assembly to combust vent gas when the pressure value of gas in the vent gas tank exceeds an upper pressure set-point value and the determined state of the main burner assembly is inactive.

In accordance with another aspect of the present disclosure there is provided a controller for controlling the combusting vent gas, the controller comprising: a processor; and a memory containing instructions which when executed by the processor cause the processor to: determine a state of a main burner assembly; determine a pressure value of vent gas in a vent gas tank; and initiate an auxiliary burner assembly to combust vent gas when the pressure value of gas in the vent gas tank exceeds an upper pressure set-point value and the determined state of the main burner assembly is inactive.

In accordance with still yet another aspect of the present disclosure there is provided an auxiliary burner assembly for combusting vent gases comprising: a pilot unit; a burner unit housed within an exhaust stack of a main burner assembly for heating a medium; and an outer pipe surrounding the burner unit and pilot unit within a center of the outer pipe, the outer pipe having a flange for coupling to an exhaust gas stack of the main burner assembly wherein the auxiliary burner assembly is utilized to combust vent gases from a vent gas tank when the main burner assembly is inactive.

In accordance with still yet another aspect of the present disclosure there is provided a computer readable memory containing instructions for controlling an auxiliary burner assembly for combusting vent gases, the instructions which when executed by a processor performing the method comprising: determining a state of a main burner assembly; determining a pressure value of vent gas in a vent gas tank; and initiating the auxiliary burner assembly to combust vent gas when the pressure value of gas in the vent gas tank exceeds an upper pressure set-point value and the determined state of the main burner assembly is inactive.

An auxiliary burner can be utilized to combust vent gases from petroleum production or processing when a main burner is not required for heating of a medium. The auxiliary burner assembly is inserted within the exhaust stack of an existing main burner to eliminate the need for additional exhaust stacks to be added. A control system consisting of a set of valves, regulators, and sensors that ensure the existing main burner achieves its purpose to maintain the desired production of heat, while using the vent gas as the source of gases for the main burner. When the main burner is not on and vent gas is present, the vent gas is directed to the auxiliary burner in the stack where the heat from the combustion of the vent gases does not add heat to main burner region. A combustion zone of the auxiliary burner is less than the main burner if an internal fire tube is utilized. The diameter of the auxiliary fire tube is less than that of the exhaust stack the airflow in the exhaust stack prevents the combustion zone of the auxiliary burner from creating excessive surface temperatures in the existing exhaust stack. At times when the main burner is not being utilized and the excess vent gas needs to be combusted one or more internal auxiliary burners can be utilized to combust the gases while the main burner is inactive.

In conditions where excess vent gas may need to be dealt with and the main burner is not active, a lower capacity auxiliary burner may not be sufficient to handle the excess vent gas. To provide a high capacity auxiliary burner, rather than using a containment area with the exhaust stack, external heat shields are provided to enable larger auxiliary burners. The external heat shields allow full use of the existing exhaust stack diameter as a combustion zone for the auxiliary burner unit. This enables an existing exhaust stack to be utilized for excess gas combustion by using the same airflow as the main burner and the auxiliary burner. No auxiliary burner flow regulation is required because the main burner already has an air flow regulator. If additional air flow control is required, a limited area auxiliary burner flow regulator can be installed.

The vent control system described provides an efficient combustor for all the components of the tank gases which may include methane, ethane, propane and butane and smaller amounts of other volatile gases. If the methane escapes to the atmosphere it has a greenhouse effect. Over a 100 year time period the global warming potential, according to the International Panel on Climate Change (IPCC) of methane is some twenty-five or more times that of the same mass of carbon dioxide. When the methane is combusted 1 kg of methane, equivalent to 25 or more kg of carbon dioxide is changed to water and 44/16=2.75 kg of carbon dioxide, thus leading to a reduction in the greenhouse effect of the vented gases. In addition, the non-methane components of the tank gas may decompose, due to natural processes in the atmosphere, to products which include methane. The advantages to such a system where an auxiliary burner is added to an existing burner assembly is the combustion of volatile organic vapors to meet environmental regulations, the reduction in total gases burned, which lessens operating costs and greenhouse gas emissions, and elimination of the need to seek approval for the addition of an additional burner to a oil and gas production site FIG. 1 depicts a top view of a main burner assembly 100 with an exhaust gas stack utilized in petroleum production and processing facilities. The enclosed volume contains the medium 102 to be heated by the main burner, such as provided by a heater. A fire tube 104 passes through the medium 102 and contains the burner flame and conducts the hot gases through the medium 102 to be heated. Although a single fire-tube 104 in a U configuration is shown in a horizontal plane, many other fire-tube configurations are possible in the configuration of the heater. The exhaust gases are conducted to a vertical exhaust stack 106 which allows the exhaust gases to escape to the atmosphere. The incoming air 114 for the fuel combustion in the fire-tube 104 passes through a flame arrestor 108, which prevents any flame inside the fire-tube 104 from igniting any combustible vapors outside of the main burner assembly 100. The flame arrestor 108 may not be required for areas where there is no likelihood of combustible vapors being present outside the main burner assembly 100. The air flow direction through the main burner 100 is indicated by the arrow 114. An air filter (not shown) may be provided to reduce the ingression of contamination to the fire-tube 104. The fuel for the main burner 100 is conducted to the fire-tube 104 by fuel assembly 110. The fuel assembly 110 may include a premixing sub-assembly (not shown) to improve the combustion process. An igniter assembly 112 is provided for igniting the burner fuel either with a pilot flame or with a spark. Many different designs of fuel assembly 110 and igniter assembly 112 are available. The fuel is provided from vent gas sources associated with the petroleum production and processing facility. The excess gas vapours must be vented or stored if not utilized by the main burner. In most cases the volume of gas does not warrant capture or transport mechanisms. The auxiliary burner provides a means of combusting the excess gas when the main burner is not required without using venting or a separate flare or incinerator.

Figure 2:
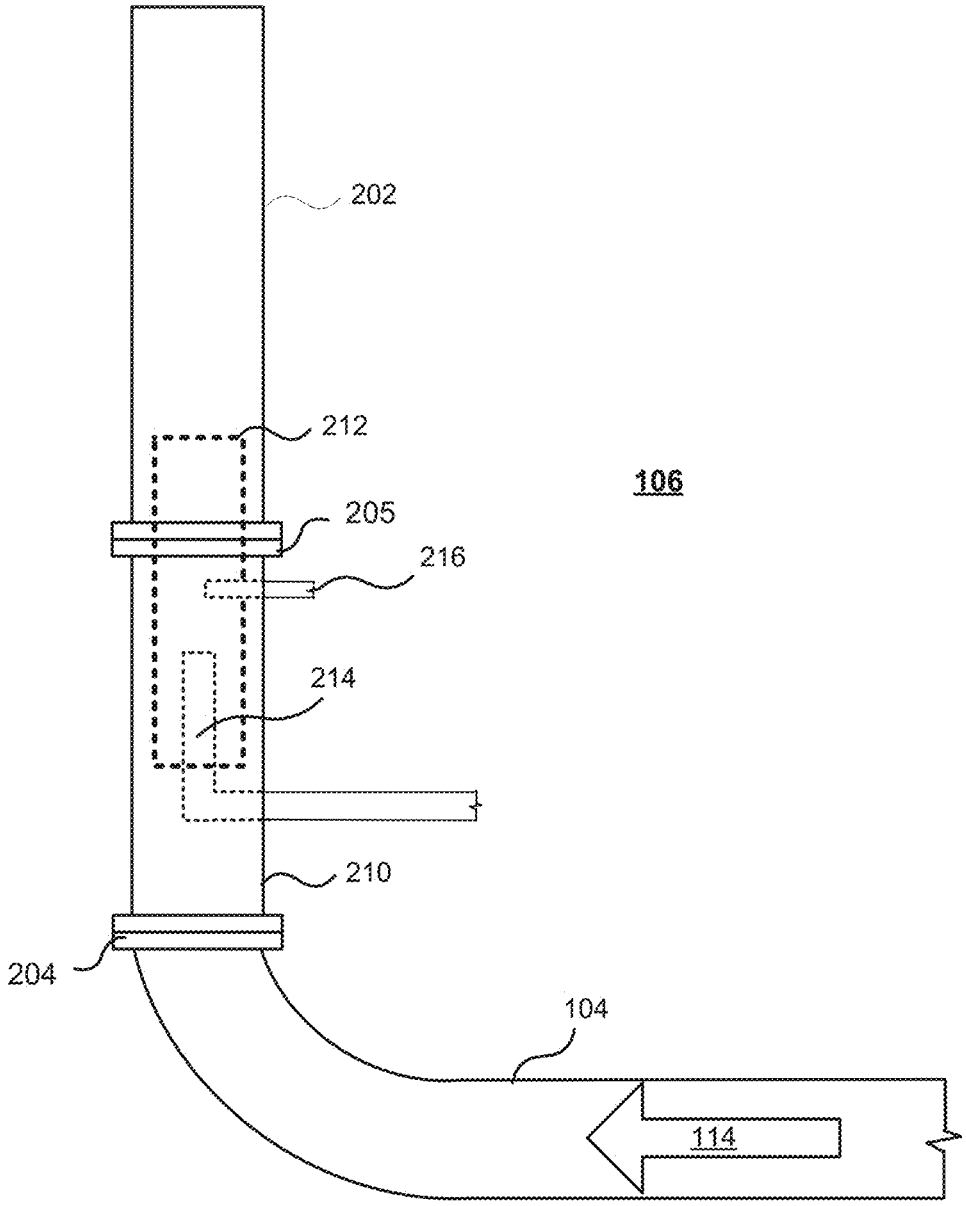
FIG. 2 shows a representation of an auxiliary burner in the exhaust stack of a main burner assembly in a side view.

FIG. 2 depicts a side view of an auxiliary burner positioned within the exhaust stack 106 of FIG. 1. The auxiliary burner assembly 210 is inserted between the exhaust gas stack 202 and the fire-tube 104 from the main burner 100 with flanges 204 and 205. The auxiliary burner assembly 210 may comprise of an inner fire-tube 212, having a smaller diameter than the exhaust gas stack 202, an auxiliary burner unit 214 and a pilot assembly 216. The inner fire tube 212, also referred to as a heat shield, may extend beyond the flange 205 into the portion of the exhaust gas stack 202. The auxiliary burner assembly 210 provides for the combustion of excess gases when medium 102 does not need additional heat and the pressure of the vent gas is above an upper pressure set-point value. By integrating the auxiliary burner assembly 210 into the exhaust stack 106, the combustion of the vent gas be provided without additional exhaust stacks and effectively controlling the amount of heat provided by the main burner to the medium. Burner control logic as described below is provided so that only the main burner in the fire tube 104 is active or the auxiliary burner assembly 210 is active, in this way the air 114 is available for either burner. The fire-tube 104 is provided to reduce the temperature of the external surface of the exhaust stack 106 in the flame region for safety and to prevent damage to the exhaust stack 106, however depending on the particular auxiliary burner 210 configurations the fire-tube 104 may not be required.

Figure 3:
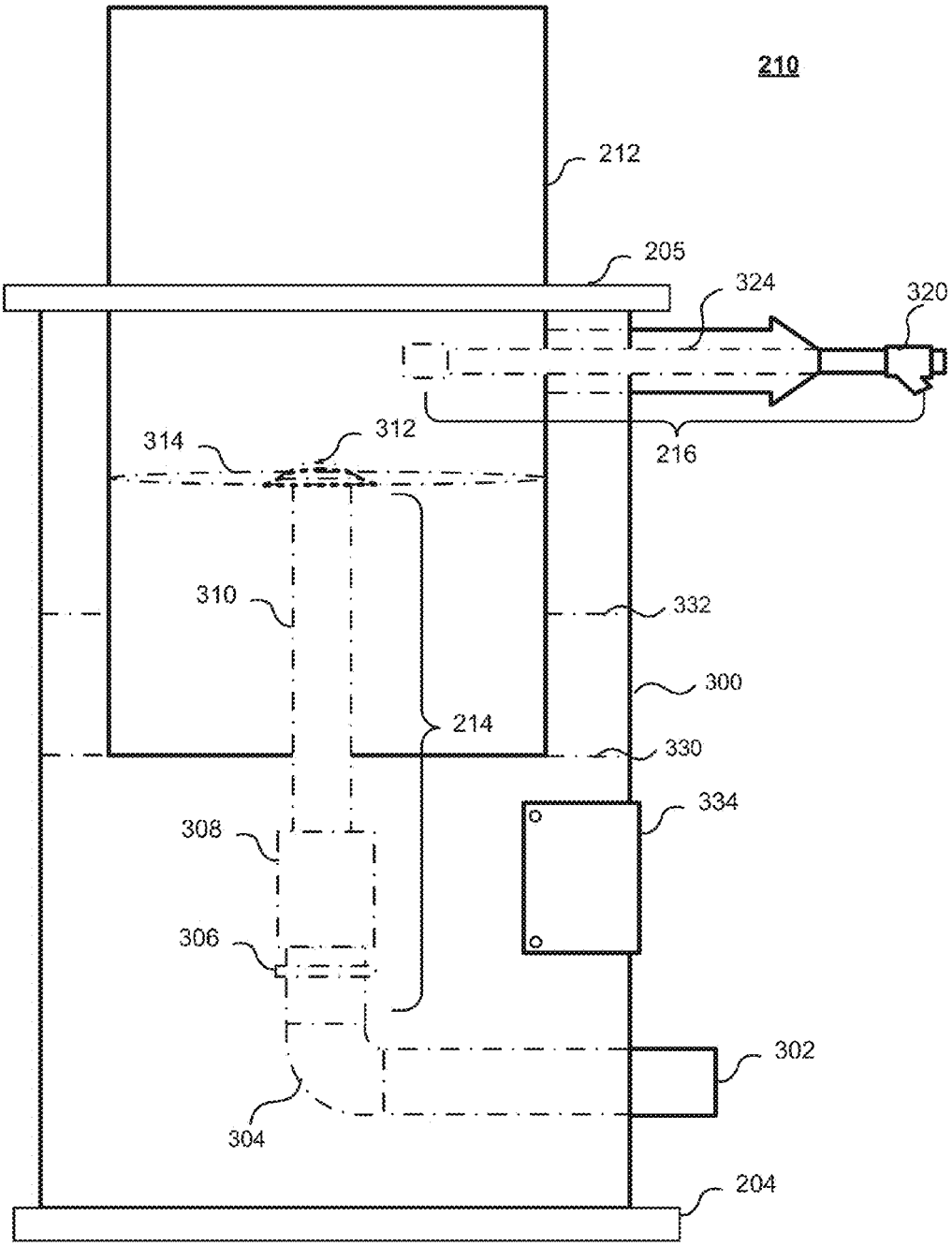
FIG. 3 shows a detailed representation of an auxiliary burner assembly.

FIG. 3 depicts a more detailed drawing of the auxiliary burner assembly 210. The auxiliary burner assembly 210 comprises an outer pipe 300 for forming part of the exhaust stack 106. The outer pipe 300 has flanges 204 and 205 having a diameter compatible with the exhaust gas stack 202 and fire-tube 104. The auxiliary burner assembly 210 provides a burner unit 214 comprising an inlet pipe 302 coupled to the gas supply via an elbow joint 304 to position the Venturi burner barrel 310 vertically in the exhaust stack 106. Between the elbow joint 304 and the Venturi burner barrel 310, an air adjustment device 306 and an air-fuel ratio mixer 308 are provided. The Venturi burner barrel 310 has an outlet nozzle 312 positioned within an inner fire tube 212, which can also be referred to as an inner heat shield which is supported within the outer pipe 300 by one or more supports 330 and 332. A secondary air adjustment 314 may be provided in the inner fire tube 212 to control the air flow through the auxiliary burner assembly 210. The pilot assembly 216 provides a pilot and igniter 320 for igniting gas feed to a pilot flame or spark by a tube 324 within the inner fire tube 212 above the burner nozzle 312. The top portion of the inner fire tube 212 may extend above a top flange 205 of the outer pipe 300 for insertion into the exhaust gas stack 202. An access door 334 may be provided to enable access to air adjustments of the auxiliary burner assembly 210. Multiple internal shields can be more effective than a single reflector. A disadvantage of metallic shields, made for example from high temperature stainless steel, is that the repeated heating and cooling gradually causes the structural deterioration of the shield material. A method for shield replacement without a complete dismantling of the burner stack is a benefit. The access door 334 may be of sufficient size to enable replacement of the heat shield to be performed by removing the cover 334 over a slot in the auxiliary burner stack section to provide access to the internal shields where the outer pipe 300 extends above the inner fire tube 212 allowing for easier direct access. The diameter of the auxiliary burner assembly 210 is equal to or larger than the diameter of the main fire tube 104.

The shields 212 may comprises dimpled sheets shaped in cylindrical shapes. The dimpling is sufficient to provide physical separation by 1 mm or more of individual layers. Alternatively the fire tube 212 may be provided by a ceramic lining within the exhaust gas stack to deal with the higher temperature in the auxiliary burner flame zone approximately 0.3 to 2.2 meters above the flange. The inner lining of the lower stack portion can be composed of a heat resistant material such as fire brick reduces the surface temperature of the metal stack.

Figure 4:
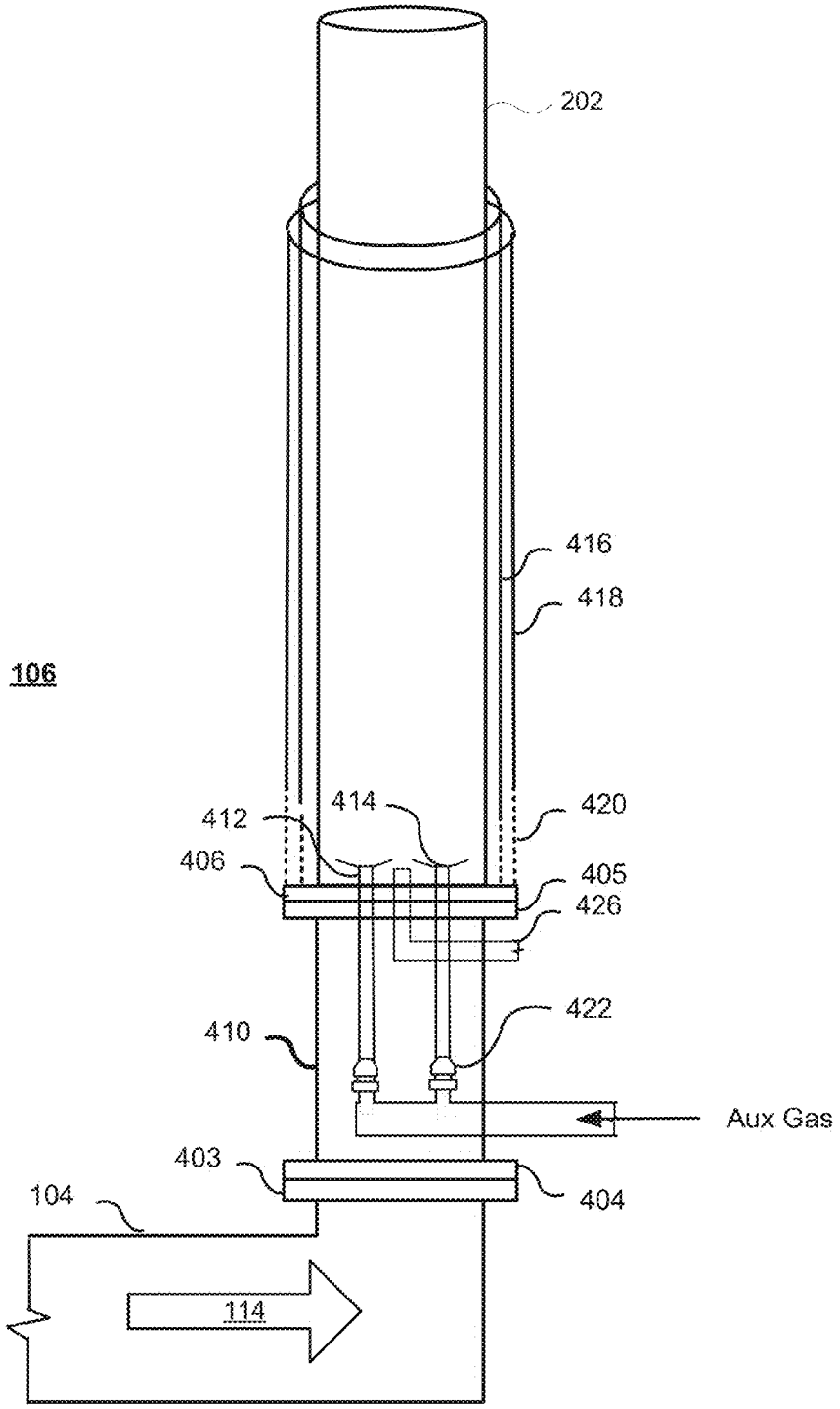
FIG. 4 shows a representation of a high capacity auxiliary burner in the exhaust stack of a main burner assembly in a side view.

FIG. 4 depicts a side view of a high capacity auxiliary burner assembly having multiple burners positioned within the exhaust stack 106 of FIG. 1. The high capacity auxiliary burner assembly configuration enables a higher output auxiliary burner to be utilized enabling the assembly to consume vent gas at a rate similar to or greater than the main burner unit. The auxiliary burner assembly 410 is inserted between the exhaust gas stack 202 and the fire-tube 104 from the main burner 100 with flanges 404 and 405 for connection to flanges 403 and 406 respectively of the exhaust stack 202. The auxiliary burners 412 and 414 can be positioned within the exhaust stack 202 to utilize the existing stack 202 as part of the fire tube for the auxiliary burners eliminating the need for additional stacks or venting methods. The auxiliary burners 412 and 414 may extend beyond, or above, the flange 205 into the upper portion of the exhaust gas stack 202. A pilot 426 is provided to ignite the auxiliary burners 412 and 414. If the auxiliary burners can be independently activated, an additional pilot may be provided for each burner if required. If there is a need to reduce the heat radiated by the exhaust stack when the auxiliary burner is in operation, one or more heat shields provided by external shrouds 416 and 418 which are situated on the exterior of the exhaust stack facilitate cooling extending from the auxiliary burner assembly 210 upwards along a length of the exhaust stack. The heat shields may surround the exhaust stack where heat would be increased due to the combustion zone of the auxiliary burner unit(s). The external heat shield enables the full diameter of the exhaust stack to be used as the combustion size increases the maximum burner size for the auxiliary burner. The external heat shield can dissipate heat output and enable the burners to handle similar or higher capacity to the main burner assembly. Spacers can be distributed between the external shrouds 416 and 418 and the exhaust stack to maintain spacing and ensure consistent airflow. Alternately the external shrouds can be dimpled to provide suitable spacing without the need for spacers. The external shrouds 416 and 418 can be made of a suitable metal formed as a tube, curved segments, bars or corrugated metal wrapping to allow for cooling air flow to the exhaust stack. A portion 420, or the entire external shroud, may have perforations or holes to facilitate cooling between the shrouds and the exhaust stack. Depending on the position of the auxiliary burner assemblies 412 and 414 the shroud may start above the auxiliary burner assembly 410 or may encompass all or part of the auxiliary burner assembly 410. Although the description and figures show two auxiliary burners one or more auxiliary burners may be utilized based upon the range of gas flow rates that may be provided by the vent gas dictated by the operation parameters of the facility. The size and length of the shroud will depend on the size and output of the auxiliary burners, the size of the combustion size and the specifications of the exhaust stack.

A high capacity auxiliary burner assembly 410 provides for the combustion of excess combustible gases when the main burner is not required and inactive and the pressure of the vent gas is above an upper pressure set-point value. The high capacity auxiliary burner size can approach or exceed the main burner size as no extra air that flows through the existing fire tube and the flame arrestor is needed for internal cooling. By integrating the auxiliary burners 412 and 414 into the exhaust stack 106, the combustion of the vent gases can be provided without additional exhaust stacks at the production/processing site. Burner control logic as described below is provided so that only the main burner in the fire tube 104 is active or the auxiliary burners 412 and 414 are active at one time, in this way the air 114 is available for either burner. Each auxiliary burner 412 and 414 may have gas mixer assemblies. Although the shrouds 416 and 418 are shown as commencing above the auxiliary burner at flange 206, they may be part of the auxiliary assembly 410 or provided in additional to the auxiliary assembly. Similarly the auxiliary assembly 410 may be integrated in to the exhaust stack or provided in a retrofit installation and the shroud installed around an existing exhaust stack.

Figure 5:
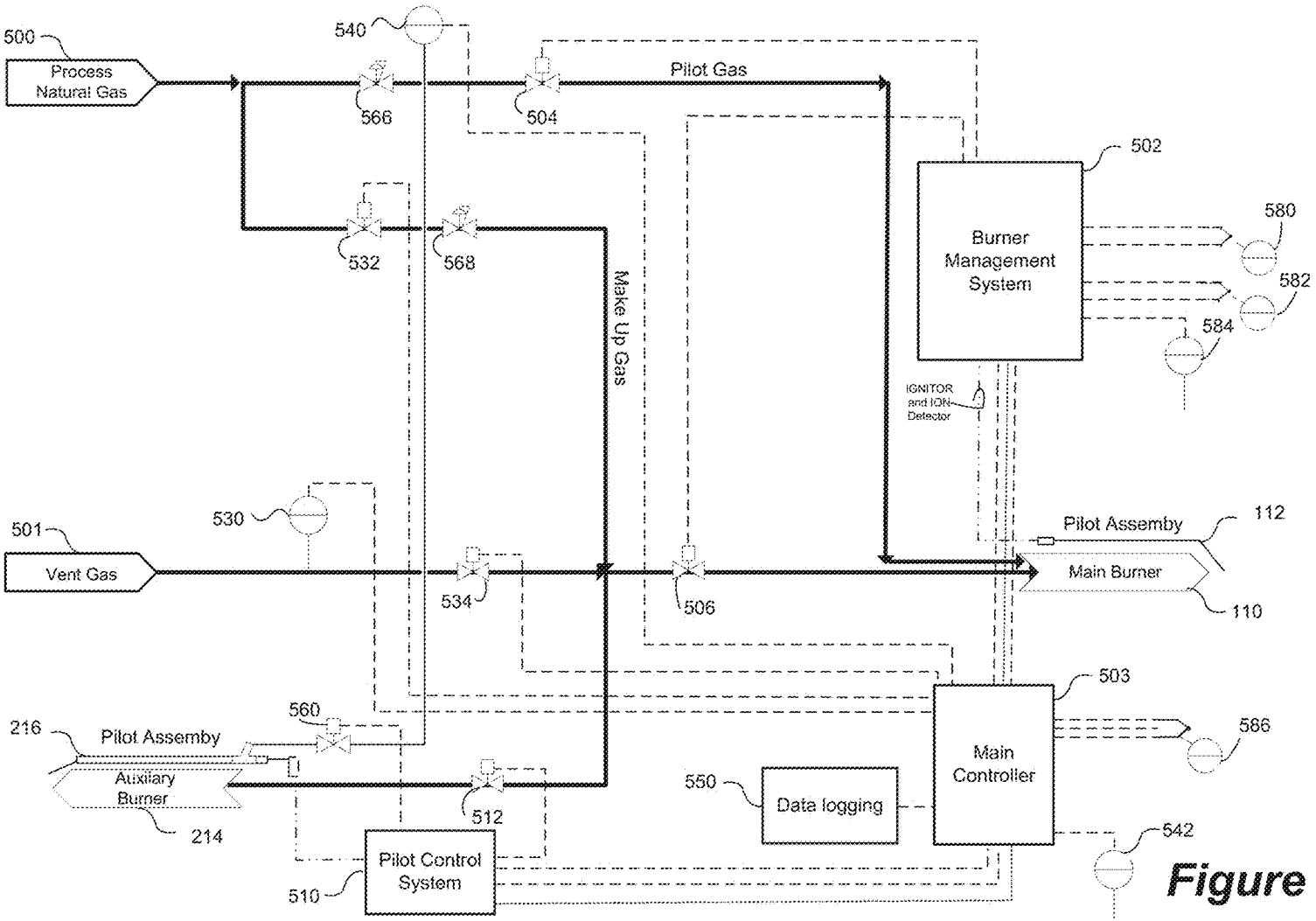
FIG. 5 shows a representation of a control system for controlling an auxiliary burner and a main burner.

FIG. 5 is a representation of a control system for controlling main and auxiliary burners for combusting vent gases. The solid lines indicate pipes or tubes for gas flow and the dashed lines indicate electrical signals. The main burner assembly 110 and its pilot assembly 112 are controlled by a Burner Management System 502 (BMS). This BMS 502 monitors one temperature or more than one temperature from a medium temperature sensor 580 (for example glycol) and an emergency shutdown temperature sensor (ESD). When a parameter such as temperature is below a user-settable medium set-point, gas is turned on to the pilot unit 112 by opening the solenoid valve 504. At the same time the BMS 502 sends pulses to a coil which generates sufficient voltage to generate a spark near the pilot unit 112. A few seconds after the spark is generated, the current on the spark electrode is measured. If a pilot flame is present there will be sufficient ion current to exceed a threshold value. If there is no flame present, the spark will be repeated followed by an ion current measurement. Once the pilot flame has been on for a desired period of time, the BMS 502 turns on the main gas pneumatic valve 506. A temporary medium set-point adjustment may be provided by the BMS 502 to determine when the medium 102 is to be heated in response to a requirement to relieve vent gas 501, for example when pressure is above an upper pressure set-point, but the BMS 502 is not yet calling for heat for the main controller 503, the Main controller 503 may cause the BMS 502 to temporarily increase the medium set-point to enable the vent gas 501 to burn in the main burner assembly 110 until the temporarily higher medium set-point is exceeded. By temporarily modifying the medium set-point the heat energy from the vent gases from a short-term pressure burst can be absorbed by the heat capacity of the medium 102 with minor upset to the system requiring heat. The burner unit 214 and its pilot assembly 216 are controlled by an Auxiliary Burner Control system (ABCS) 510. The ABCS 510 ignites the pilot by opening solenoid shut-off valve 560 and after the pilot has been proven, the solenoid operated shut-off valve 512 is opened to bring gas to the burner unit 214 of the auxiliary burner assembly 210.

The BMS 502 continuously monitors the temperature of the medium 102 needing heat by measuring the output of a thermocouple 580 in the medium 102 and subject to the low liquid level switch 584 and the gas temperature 582, turns on its pilot if heat is needed. After a delay to confirm the pilot of pilot assembly 112 is on, the BMS 502 opens the valve 506 for the main burner 110. The status of the pilot is sent to the main controller 503 by the digital input to the main controller 503. When the pilot of the pilot assembly 112 is on, the main controller 503 controls the gas flow according to the following criteria:

If vent gas pressure 501 from a vent gas, measured by the pressure sensor 530, is below the lower pressure set-point, the solenoid operated shut-off valve 532 is opened to allow the process gas 500 to flow to the main burner 110.

If vent gas 501 pressure is above a specified first pressure set-point, the solenoid operated shut-off valve 534 is opened to allow the vent gas 501 to flow to the main burner 110 until the vent gas 501 pressure drops below the lower pressure set-point. The specified first pressure set-point can either be the lower pressure set-point plus a pressure margin or an upper pressure set-point.

If the vent gas 501 pressure does not drop below a specified value within a specified period of time, the BMS 502 is remotely shut-off causing the pilot 112 and main burner 110 to go off. The auxiliary burner may then be utilized to reduce the pressure as the auxiliary burner may have higher burner capacity than the main burner.

When the main pilot 112 is off, indicating no heat is needed by the medium 102, the main controller 503 controls the gas flow according to the following criteria:

If the vent gas 501 pressure measured by the pressure sensor 530 is below the lower pressure set-point no gas flow valves are opened.

If the vent gas 501 pressure is above the upper pressure set-point, the ABCS 510 is turned on remotely. The ABCS 510 causes the pilot 216 to ignite using similar criteria to the BMS 502. When the pilot 216 is confirmed to be operating, the ABCS 510 opens solenoid operated shut-off valve 512 and solenoid operated shut-off valve 534 allowing the vent gas 501 to flow to the auxiliary burner unit 214 until the vent gas 501 pressure drops below the lower pressure set-point.

Figure 6:
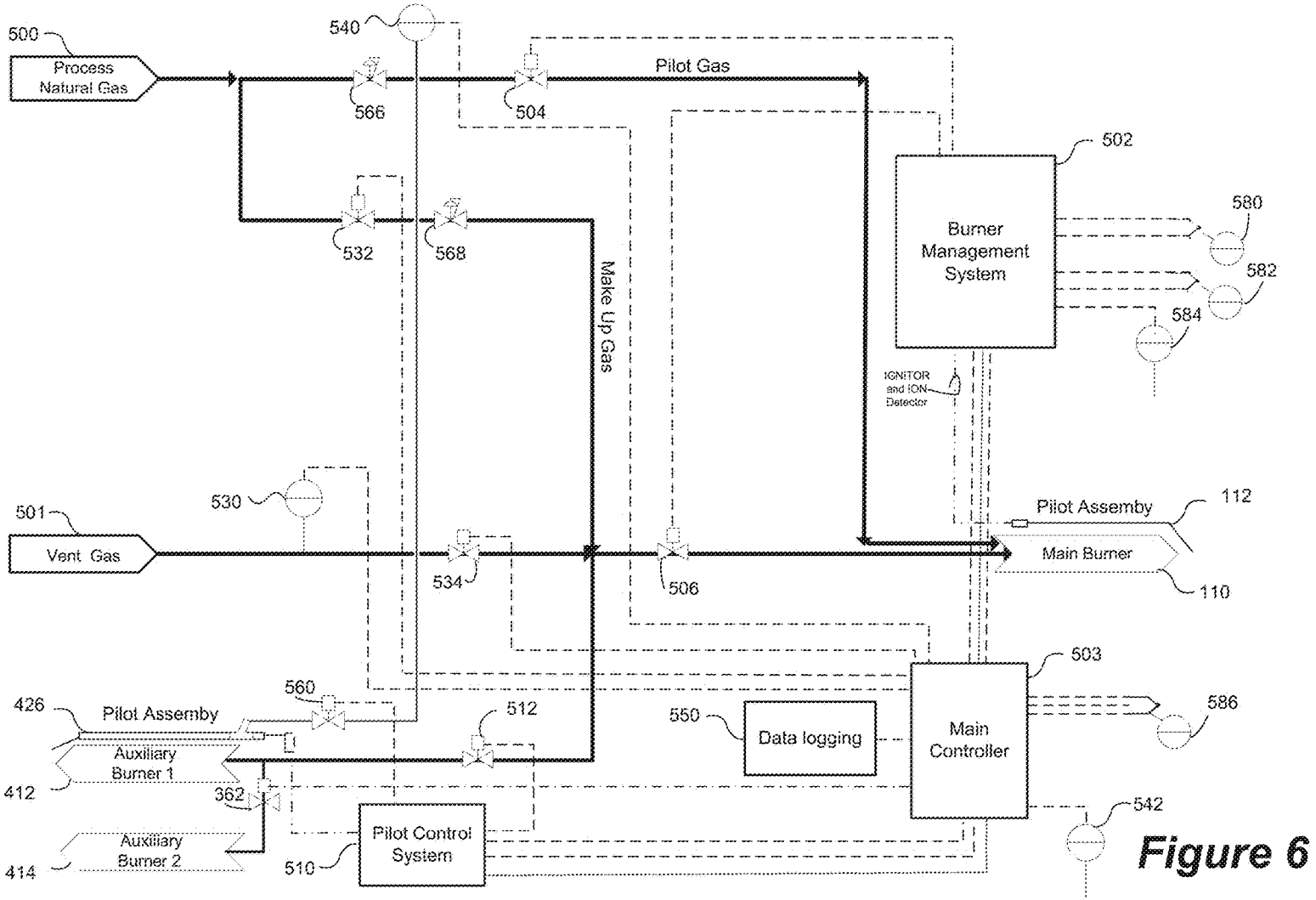
FIG. 6 shows a representation of a control system for controlling a high capacity auxiliary burner and a main burner.

The main controller 503 monitors the low level pressure switch 540, and does now allow any parts of the system to operate if the process natural gas 500 pressure is too low. If the high-level switch 542 in the liquids knock-out container for the vent gas 501, the burner is not permitted to burn the vent gas 501. Additional pressure control regulators 566 and 568 may be provided in the system to regulate gas flow within the system. The ambient temperature may be received by the main controller 503 from sensor 586 to enable control modifications according to the ambient temperature or to enable ambient temperature corrections to orifice flow calculations. Referring to FIG. 6, if multiple auxiliary burners 412 414 such as shown in FIG. 5 are utilized, one or more valves 562 may be used to control initiation of a respective auxiliary burner based upon changes in gas flow rates. For example the burners may be of different sizes where one burner is utilized for a low flow rate and a second burner is utilized for a higher rate and both burners are utilized when full capacity is required. An optional data-logging device 550 can be provided to collect process information on the system operation.

It should be understood that there may be variations in the logic details and the choice and positioning of control and monitoring devices and the implementation disclosed should not be considered limiting in any way. The described system and method enable a desired amount of heating to be maintained by using as much vent gas as possible and ensuring the vent gas vapors are combusted to prevent the escape of the unburned vent gases to the atmosphere. Although the control functions described in relation the burner management system, ABCS, and main controller may be associated with a particular controller containing a processor, the functions may be performed by a single controller or processor; alternatively the functions may be allocated across multiple controllers or processors. The control functions are provided by at least a processor having an associated memory, the memory providing instructions for performing one or more functions associated with controlling a main burner and auxiliary burner to combust vent gases of a petroleum production and processing facility.

Figure 7:
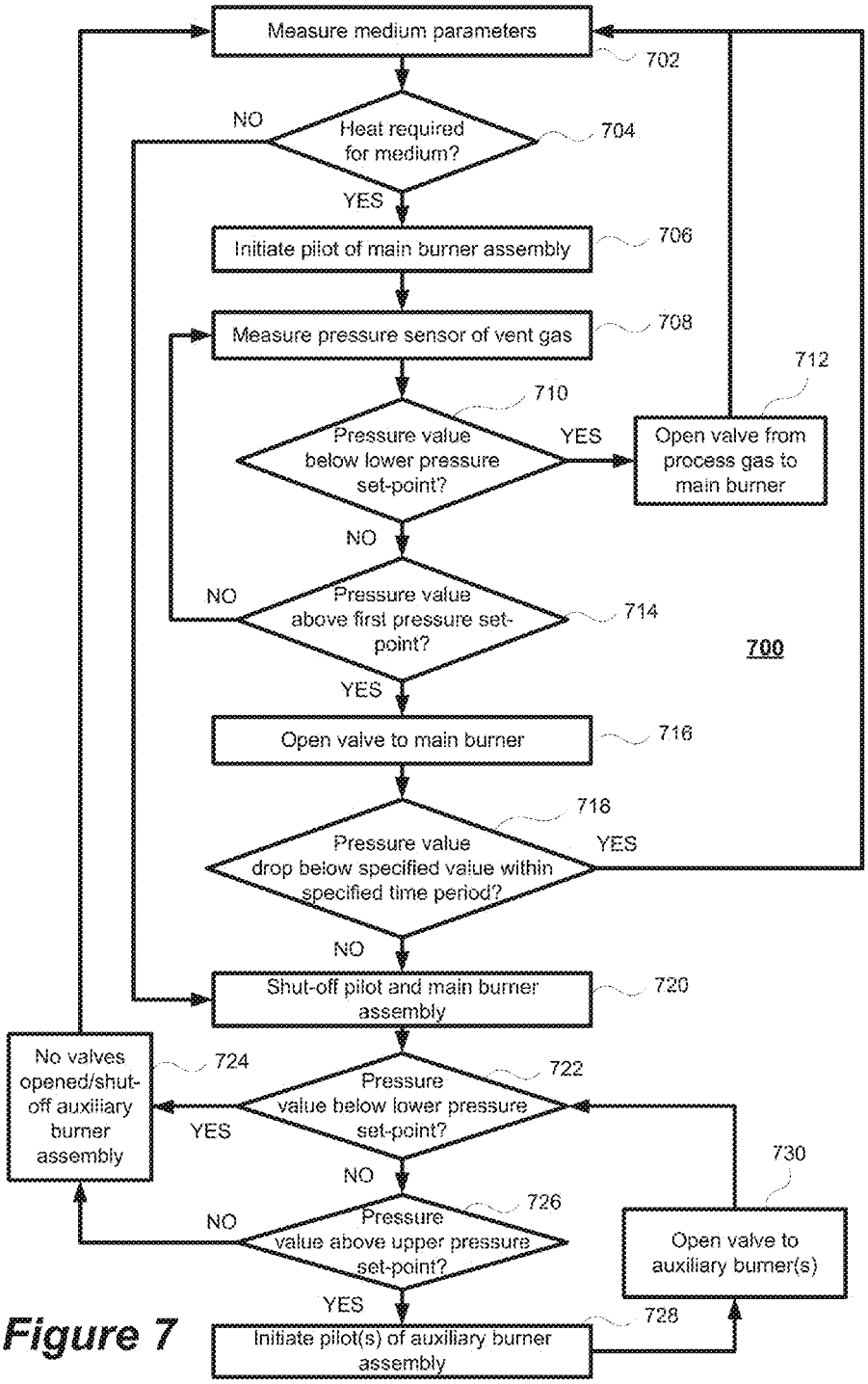
FIG. 7 shows a method for controlling a main burner and an auxiliary burner for combusting vent gases.

FIG. 7 shows a method for controlling a main burner and an auxiliary burner assembly for combusting vent gases. The medium coupled to the system is monitored (702) by the BMS 502 by using one or more parameters to determine heating requirements such as but not limited to medium temperature, ambient temperature, a low liquid level indication and gas temperature. If heat is required for the medium (YES at 704) the pilot of the main burner is initiated, as discussed previously, and it is confirmed that the pilot of the main burner is active (706). If the pilot is not successfully initiated a fault condition may be identified. A pressure sensor of the vent gas 701 is monitored (708) to determine if the pressure value is below a lower pressure set-point value. If the pressure value is below a lower pressure set-point value (YES at 710) a valve to flow process gas to the main burner is opened (712). If the pressure is not below the lower pressure set-point value (NO at 710) it is determined if the pressure is above a first pressure set-point value greater than the lower pressure set-point value. If the first pressure set-point value for the pressure is exceeded (YES at 714), a valve to provide gas from the vent gas to the main burner is opened (716), and otherwise (NO at 712) the pressure of vent gas is monitored (708). If the pressure does not drop below a specified value within a specified period of time (NO at 718) the pilot and main burner is shut off (720). The pilot and main burner may be shut-off as a safety criterion to prevent over-heating of the exhaust stack or the fire-tube and to meet regulatory requirements. The capacity of the combined auxiliary burners may be larger than the main burner assembly capacity; therefore if the main burner capacity is insufficient to reduce the pressure then the vent gas is switched over to the higher capacity auxiliary burners. If the pressure does drop to a specified value within a specified period of time, (YES at 718) the heating of the medium continues (702) until requirements change.

If the main burner and pilot assembly are not active, the auxiliary burners can be initiated if required. If the gas pressure is below the lower pressure set-point (YES at 722) no valves are opened (724) and the auxiliary burners are not initiated. Alternatively, if the auxiliary burners are already active, the associated valves are closed to shut-off the auxiliary burner assembly. If the gas pressure is below the upper pressure set-point (NO at 726) no valves are opened (724) and the auxiliary burner is not initiated. If the gas pressure is above the lower pressure set-point (NO at 722) and is above the upper pressure set-point (YES at 726) the auxiliary pilot is initiated (728) as discussed above. Once it has been confirmed that the pilot is active the valve from the vent gas to the auxiliary burner(s) is opened (730) and the decision process starting at (702) is repeated until the upper or lower vent gas pressure set-points are exceeded. Alternatively, if the medium heating requirements change (702) the auxiliary burner assembly may be turned off (705) and the main burner initiation process commenced (706). If multiple auxiliary burners are provided the selection of which of the auxiliary burners that are required may be determined based upon gas flow rates and capacity ranges of each of the auxiliary burners. If there is a need to quickly switch the vent gas flow from the main burner to the auxiliary burner, the auxiliary pilot can be on at all times.

Figure 8:
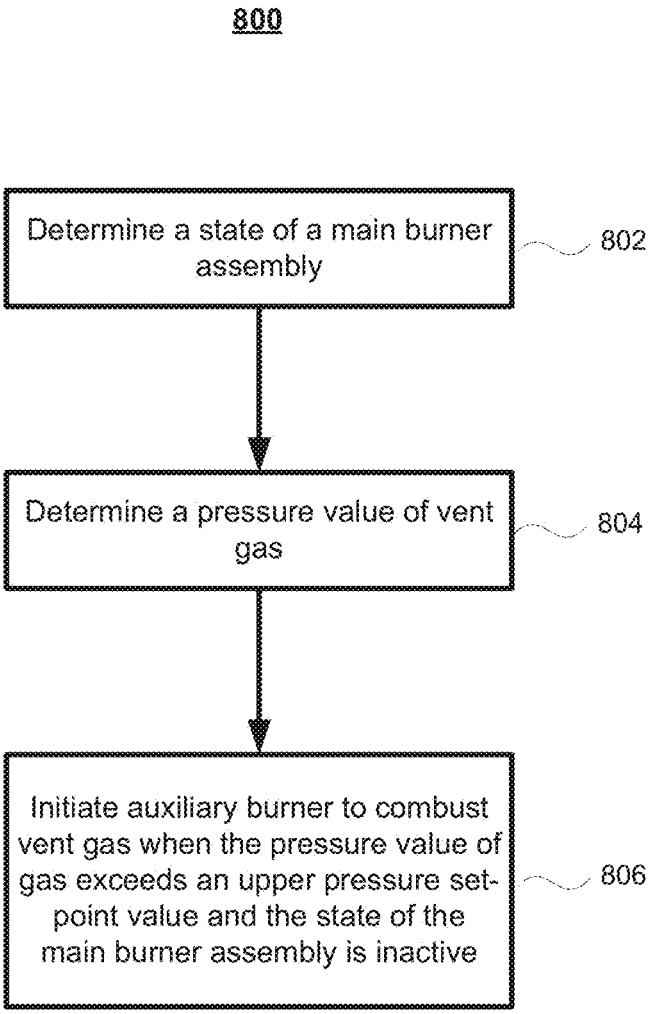
FIG. 8 shows a method for combusting vent gases using an auxiliary burner.

FIG. 8 shows a method for controlling an auxiliary burner for combusting vent gases. The auxiliary burner is located within the exhaust stack associated with the main burner assembly where only one burner is utilized at a time. The integrated auxiliary burner assembly enables the same exhaust stack as the main burner assembly while effective combusting exhaust gases and providing heating of a medium when required. A controller determines a state of a main burner assembly (802). The main burner assembly is associated with a medium which is heated either by the process gas or by the vent gases provided by the petroleum production and processing facility. The medium is heated when parameters associated with the medium meet specified requirements. For example, the main burner assembly may be activated when a medium/temperature set-point associated with the medium is reached. When the main burner assembly is not required to heat the medium, or inactive, a pressure value of vent gas is determined (804). When the pressure value of gas in the vent gas exceeds an upper pressure set-point value, and the state of the main burner assembly is inactive, the auxiliary burner is initiated to combust the excess vent gas (806).

Figure 9:
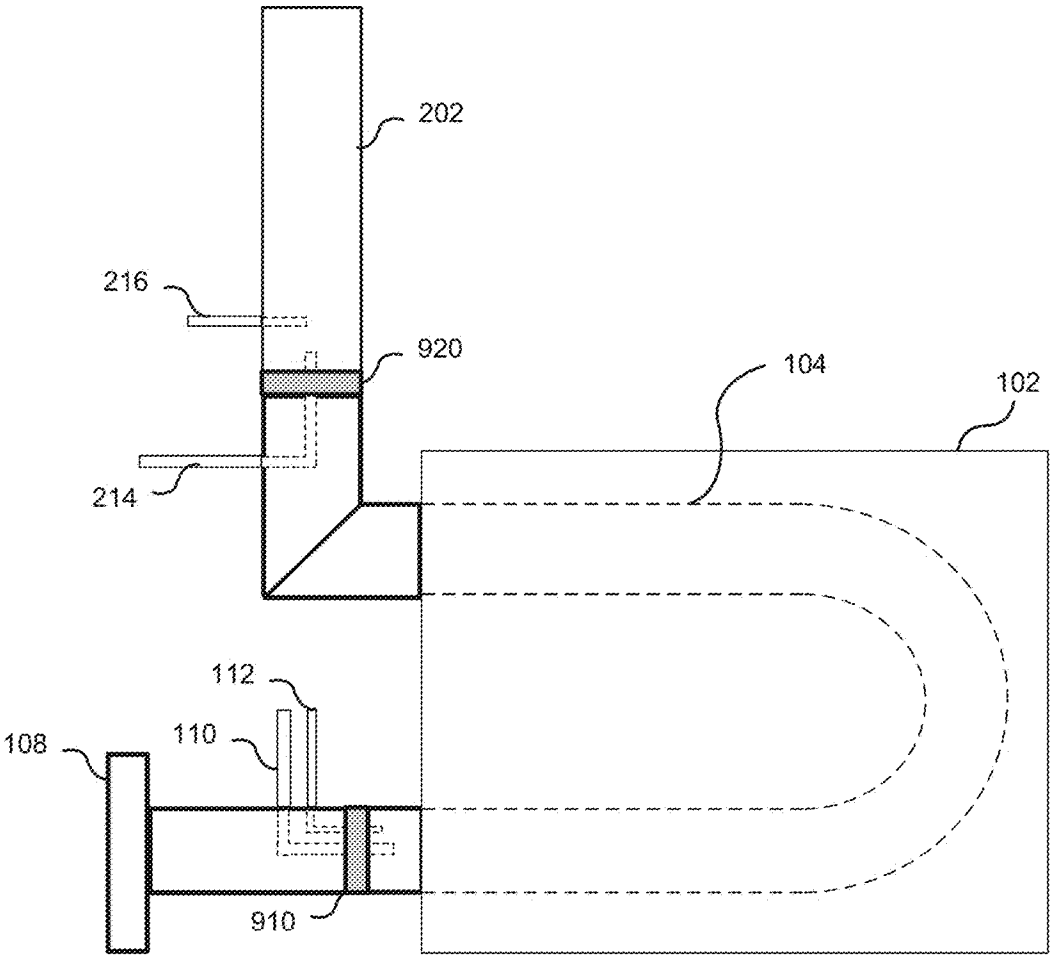
FIG. 9 shows a representation of an auxiliary burner assembly utilizing baffles.
Figure 10:
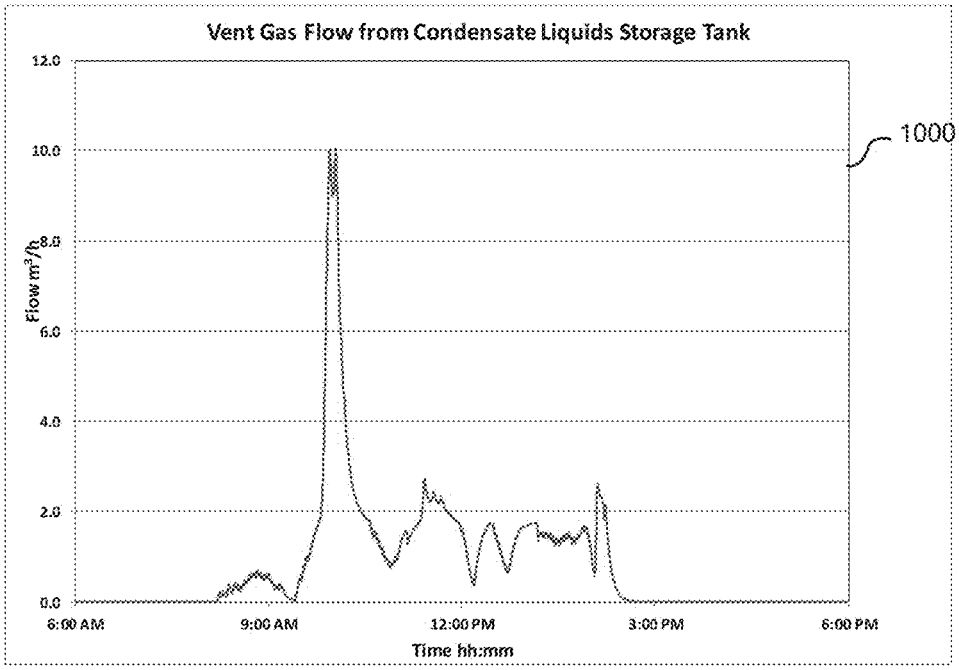
FIG. 10 shows a graph of vent gas flow from a petroleum liquids storage tank.

FIG. 9 shows a representation of an embodiment of the auxiliary burner assembly having baffles. Within the fire-tube 104 a main baffle 910 provides sufficient air flow resistance to ensure the hot gases of combustion from the main burner 110 preferentially flow through the fire-tube 104 and the exhaust stack 202. Also the baffle 910 can be partially opened or closed to ensure the air to fuel ratio for the main burner 110 is suitable for optimum combustion conditions. The BMS starts and stops the main burner 110 to ensure the temperature of the process heater, in this case a glycol bath, is maintained near to a desired temperature set-point.

In some cases the maximum capacity of the auxiliary burner is insufficient to meet or exceed the rate at which vent gases are generated by other processes. An example of the variability in vent gas flow rate from a petroleum liquids storage tank is shown in the graph 1000 of FIG. 10 where the vent gas flow from the petroleum liquids storage tank varies from 0 to 10 $m^3/h$ over a period of a few hours.

Figure 11:
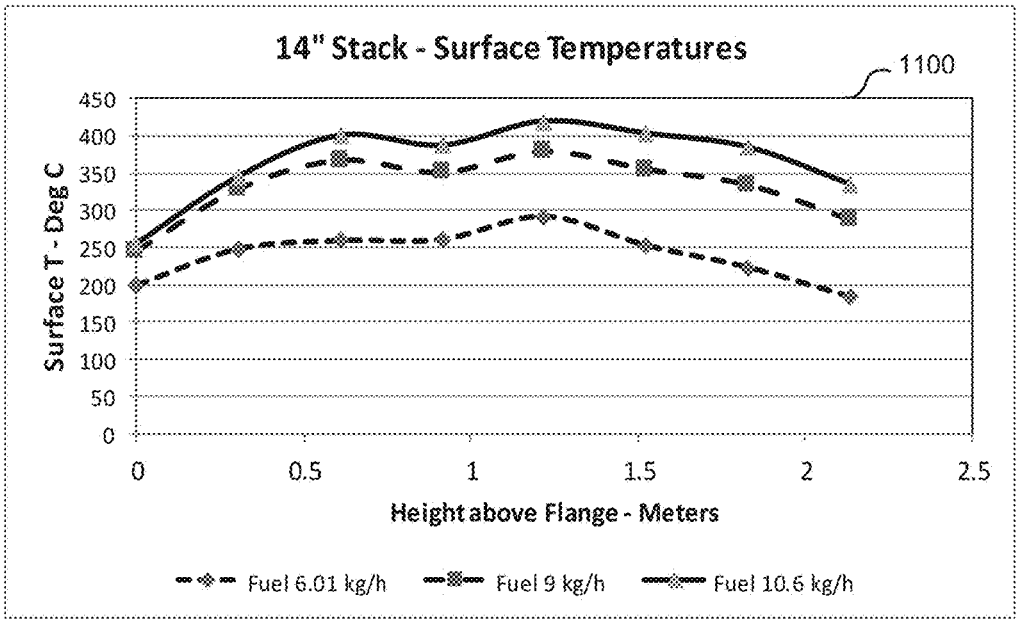
FIG. 11 shows a graph of stack surface temperature when the auxiliary burner is operational.

A limitation in the maximum capacity of the auxiliary burner is the temperature of the stack portion adjacent to the flame zone. The maximum temperature is determined by the material properties of the stack and the self-ignition temperature of an air-fuel mixture that may exist adjacent to the stack. A vertical temperature profile of the stack surface temperatures observed when the auxiliary burner is operational is shown in graph 1100 of FIG. 11. The height above the flange is the position of the temperature measurement above flange 205 in FIG. 2. For this test the inner pipe 212 was not present. FIG. 11 shows a graph 1100 which demonstrates that the highest temperature portion is limited in length.

The removal of the inner heat shield 212, removal of the auxiliary baffle 920, and/or an increase in the stack diameter may be used to increase the auxiliary burner capacity. However these modifications do not increase the amount of air available that must be drawn in through the existing fire-tube and flame arrestor. It is well known that an increase in stack height does increase the air flow, but there are practical and economic reasons that preclude a large increase in stack height. A further method of providing the additional air required by the auxiliary burner is the addition of a fan between the flame arrestor 108 and the main burner 110. The fan can provides the additional air required by the auxiliary burner.

Figure 12:
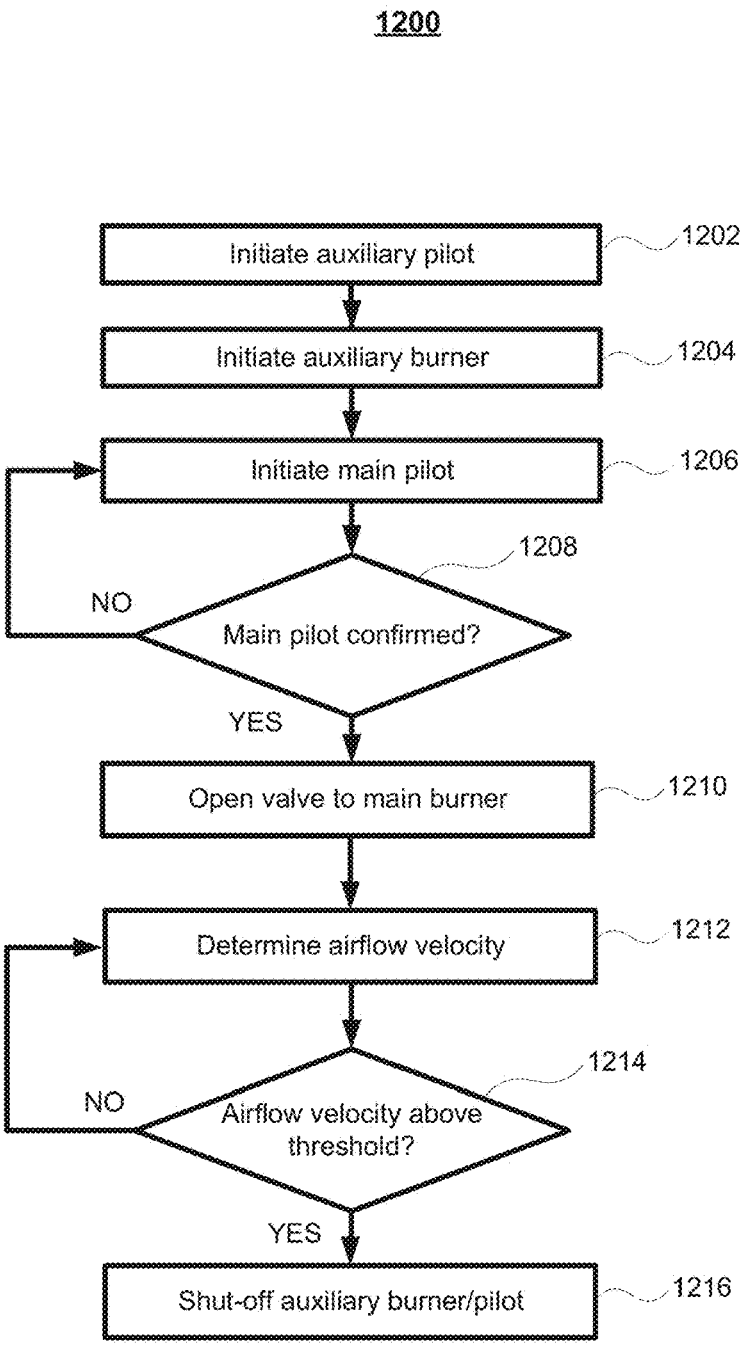
FIG. 12 shows a method of controlling a main burner without using an auxiliary baffle.

Alternatively, FIG. 12 provides a method of controlling a main burner without using an auxiliary baffle. Removal of the main burner baffle 910, shown in FIG. 9, will remove some of the air flow resistance when the main burner 110 is off and the auxiliary burner 214 is on. The method may be implemented may for example when initiating the main burner (706) in FIG. 7. To ensure the desired direction of the air flow in the main fire-tube 104 prior to the ignition of the pilot flame for the main burner and the start of the main burner, the auxiliary pilot (1202) if not already on and, if necessary, the auxiliary burner (1204) is started before the start of the main burner pilot (1206). After a suitable time delay for the establishment of air flow up the stack (1208), the main burner pilot is started and once proved to be satisfactory (YES at 1208) the main burner fuel is turned on to start the main burner (1210). The air flow velocity can be calculated from the flow rate of the burner fuel and the exhaust oxygen concentration by well-known methods (1212). A suitable delay period can be determined from the air flow velocity when the auxiliary burner and/or its pilot are on (Yes 1214). Just after the main flame is ignited, the auxiliary burner and, if desired, its pilot can then extinguished by turning the fuel off (1216). An initial estimate of reduction in flow resistance caused by the elimination of the main burner baffle is 40%. This, in turn, enables more air to be available for the auxiliary burner and allow for an increase in the auxiliary burner capacity.

Figure 13:
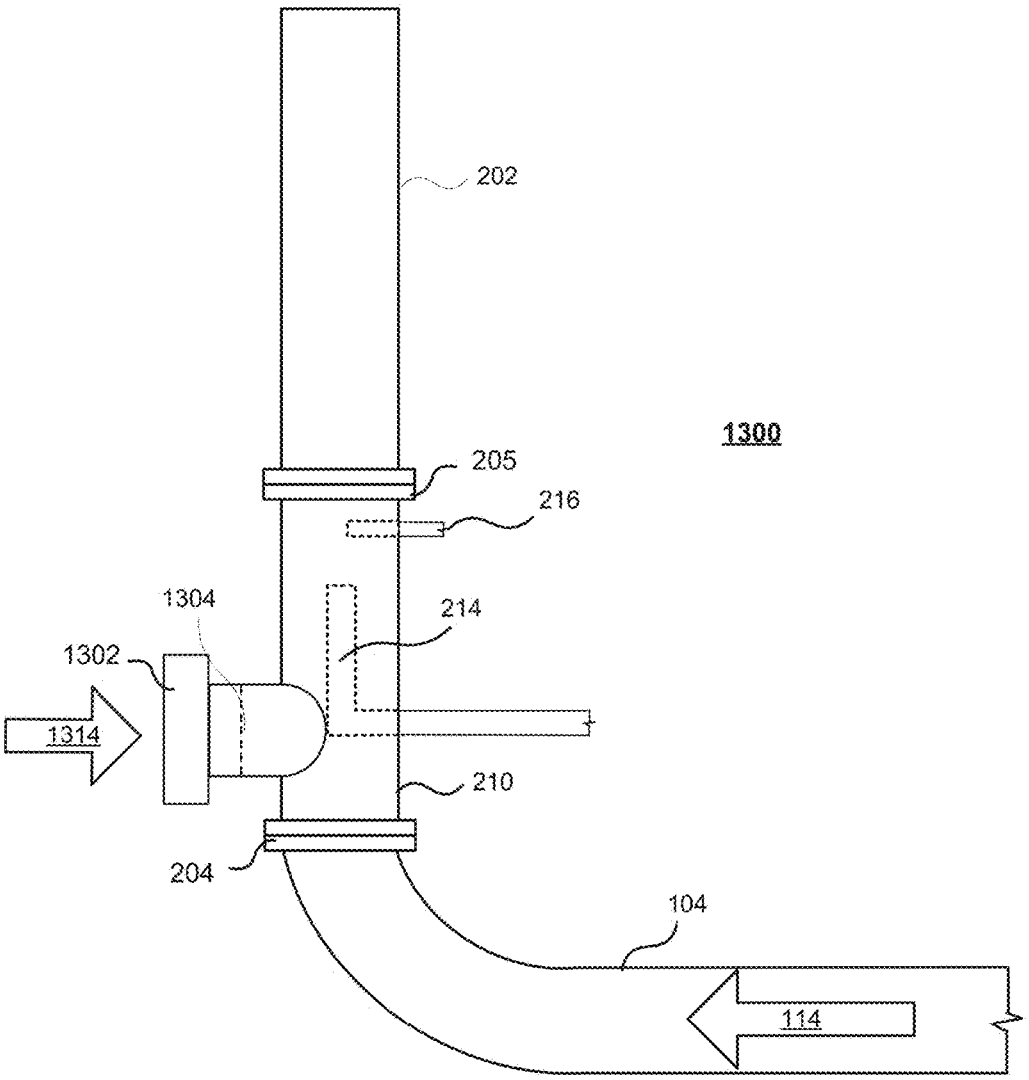
FIG. 13 shows a representation of an auxiliary burner with a flame arrestor.

FIG. 13 shows a representation of an auxiliary burner with a flame arrestor. In order to provide additional air for the auxiliary burner a flame arrestor 1302 can be added to the stack just below the auxiliary burner position. The additional air provides a means of absorbing more combustion heat from the auxiliary burner(s) and thus increasing the capacity of the auxiliary burner(s). When the auxiliary burner 214 is on, the flame will draw air from both the main flame arrestor 108, shown in FIG. 1 and air 1314 from the secondary flame arrestor 1302. When the main burner 110 is on, the flow resistance for the exhaust gases is less to flow up the stack than to flow through the flame arrestor such that the secondary flame arrestor 1302 does not act as a conduit for the main burner exhaust gases. In fact some air is added to the exhaust gases from the main burner 110. An electronically activated shutter 1304 may be inserted to further ensure the exhaust gases for the main burner will not be diverted through the secondary flame arrester 1302.

In some embodiments, any suitable computer readable media can be used for storing instructions for performing the methods described herein to be executed by a processor. For example, in some embodiments, computer readable media can be transitory or non-transitory. For example, non-transitory computer readable media can include media such as magnetic media (such as hard disks, floppy disks, etc.), optical media (such as compact discs, digital video discs, Blu-ray discs, etc.), semiconductor media (such as flash memory, electrically programmable read only memory (EPROM), electrically erasable programmable read only memory (EEPROM), etc.), any suitable media that is not fleeting or devoid of any semblance of permanence during transmission, and/or any suitable tangible media.

Although the description discloses example methods, system and apparatus including, among other components, software executed on hardware, it should be noted that such methods and apparatus are merely illustrative and should not be considered as limiting. For example, it is contemplated that any or all of these hardware and software components could be embodied exclusively in hardware, exclusively in software, exclusively in firmware, or in any combination of hardware, software, and/or firmware. Accordingly, while the fore-going describes example methods, systems and apparatus, persons having ordinary skill in the art will readily appreciate that the examples provided are not the only way to implement such methods and apparatus.

The scope of the claims should not be limited by the preferred embodiments set forth in the examples, but should be given the broadest interpretation consistent with the description as a whole. In the design of the auxiliary burner section, one or more of the described embodiments may be used to meet the desired maximum vent gas flow rate to the auxiliary burner. It is recognized that variations in the described innovations are possible.

The invention claimed is:

1. An auxiliary burner assembly for combusting excess combustible vent gases for use with a main burner assembly, the auxiliary burner assembly comprising:

a first auxiliary burner unit housed within an exhaust stack of the main burner assembly above the main burner assembly, the first auxiliary burner unit for combusting vent gases received from a vent gas supply line;

an outer pipe for supporting the first auxiliary burner unit within a center of the outer pipe having a diameter equal to or larger than a main fire tube of the main burner assembly; and a controller for controlling ignition of the main burner, wherein the first auxiliary burner is ignited prior to igniting of the main burner assembly to improve airflow through the exhaust stack without using a baffle, wherein when airflow within the exhaust stack is above a pre-determined the first auxiliary burner unit is shut-off.

2. The auxiliary burner assembly of claim 1 wherein the auxiliary burner assembly further comprises an auxiliary fire-tube within an exhaust stack of the main burner assembly, the auxiliary fire-tube encircling the auxiliary burner unit.

3. The auxiliary burner assembly of claim 2 wherein the auxiliary fire-tube comprises one more dimpled sheets.

4. The auxiliary burner assembly of claim 2 wherein the outer pipe further comprises an access door to provide access in auxiliary fire-tube for replacement.

5. The auxiliary burner assembly of claim 4 wherein the fire-tube is below a top portion of the outer pipe, the auxiliary fire-tube supported within the outer pipe by at least one support.

6. The auxiliary burner assembly of claim 2 wherein the auxiliary fire-tube extends beyond a top portion of the outer pipe, the auxiliary fire-tube supported within the outer pipe by at least one support.

7. The auxiliary burner assembly of claim 2 wherein the burner unit further comprising: a burner barrel positioned within the auxiliary fire-tube;

an inlet pipe coupling the burner unit to the vent gas; and an elbow connected to the inlet pipe for providing gas to the burner barrel.

8. The auxiliary burner assembly of claim 7 where the burner barrel is a Venturi burner barrel terminating with a nozzle with the fire-tube of the auxiliary burner assembly.

9. The auxiliary burner assembly of claim 8 wherein a secondary air adjustment is provided within the fire-tube proximate to the nozzle of the burner barrel.

10. The auxiliary burner assembly of claim 1 further comprising a second auxiliary burner unit housed within the exhaust stack with the first auxiliary burner unit.

11. The auxiliary burner assembly of claim 1 further comprising: an external heat shield surrounding the exhaust stack relative to a combustion zone of the first auxiliary burner unit within the exhaust stack, the external heat shield extending up a length of the exhaust stack above the first auxiliary burner unit.

12. The auxiliary burner assembly of claim 11 wherein the external heat shield comprises one or more dimpled metal shrouds.

13. The auxiliary burner assembly of claim 1 further comprising an auxiliary flame arrestor positioned below the auxiliary burner unit.

14. The auxiliary burner assembly of claim 1 further a cylindrical portion having a top and bottom flange for coupling within the exhaust stack, the first auxiliary burner positioned within the cylindrical portion.

15. The auxiliary burner assembly of claim 1 further comprising a pilot for igniting the first auxiliary burner.

16. The auxiliary burner assembly of claim 1 wherein a fan is utilized to provide improved airflow through the exhaust stack.

17. A method for initiating a main burner assembly without a baffle within an exhaust stack, the method comprising:

initiating an auxiliary burner of an auxiliary burner assembly positioned in the exhaust stack above the main burner assembly to initiate air flow within the exhaust stack;

initiating a main pilot of the main burner assembly;

initiating the main burner of the main burner assembly;

determining air flow velocity within the exhaust stack; and shutting off auxiliary burner assembly when air flow velocity reaches a pre-determined threshold and the main burner assembly is ignited.

18. The method of claim 17 further comprising initiating a pilot of the auxiliary burner assembly prior to initiating the auxiliary burner.

19. The method of claim 17 wherein the auxiliary burner assembly is shut off when vent gases from a vent gas tank are below a first pressure set-point.

20. The method of claim 17 wherein the auxiliary burner assembly operational when vent gases from a vent gas tank are above a first pressure set-point.

* * * * *